US009822545B1

(12) United States Patent
Kapur et al.

(10) Patent No.: US 9,822,545 B1
(45) Date of Patent: Nov. 21, 2017

(54) DEPLOYABLE SHADING STRUCTURE

(71) Applicant: DISNEY ENTERPRISES, INC., Burbank, CA (US)

(72) Inventors: Raakhi Kritaanjli Kapur, Valencia, CA (US); Zachary Dinndayal Morgan, Pasadena, CA (US); Stephanie Huerre, Venica, CA (US); Susan Hamilton, Los Angeles, CA (US); Matias Adrian Cena, Upland, CA (US); Carolina Isabel Rodriguez, Altadena, CA (US); Steven John Pless, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 15/143,004

(22) Filed: Apr. 29, 2016

(51) Int. Cl.

| | |
|---|---|
| ***E04H 15/28*** | (2006.01) |
| ***A45B 19/00*** | (2006.01) |
| ***E04H 15/54*** | (2006.01) |
| ***E04H 15/58*** | (2006.01) |
| ***E04H 15/32*** | (2006.01) |
| *A45B 23/00* | (2006.01) |

(52) U.S. Cl.
CPC ..... *E04H 15/28* (2013.01); *E04H 15/322* (2013.01); *E04H 15/54* (2013.01); *E04H 15/58* (2013.01); *A45B 2019/002* (2013.01); *A45B 2019/008* (2013.01); *A45B 2023/0018* (2013.01)

(58) Field of Classification Search
CPC ... E04H 15/28; A45B 19/00; A45B 2019/008; A45B 2019/002; A45B 2023/0018; A45B 25/22; A45B 2019/001
USPC ..... 135/98
See application file for complete search history.

(56) References Cited

U.S. PATENT DOCUMENTS 2,788,792 A * 4/1957 Koller ..... A45B 25/22 135/15.1
5,441,068 A * 8/1995 Rasch ..... A45B 23/00 135/20.3

(Continued)

FOREIGN PATENT DOCUMENTS

DE 202014101944 U1 * 7/2015 ..... A45B 23/00
EP 0596180 A1 * 5/1994 ..... A45B 19/00

(Continued)

*Primary Examiner* — Noah Chandler Hawk
(74) *Attorney, Agent, or Firm* — Marsh Fischmann & Breyfogle LLP; Kent A. Lembke

(57) ABSTRACT

A system for providing weather protection including shading in an automated and selective manner. The system includes an enclosure with an inner chamber and an outlet to the inner chamber. The system also includes a canopy and a deploy and retract assembly, which includes a canopy support assembly supporting the canopy. The deploy and retract assembly operates to move the canopy support assembly to move the canopy into the inner chamber and out of the inner chamber. The system further includes a controller generating control signals to operate the deploy and retract assembly. Specifically, this assembly is configured to retract the canopy by moving the canopy support assembly to move the canopy through the outlet into the inner chamber and further is configured to deploy the canopy by moving the canopy support assembly to move the canopy through the outlet to be at least partially outside of the inner chamber.

19 Claims, 10 Drawing Sheets

(56) References Cited

U.S. PATENT DOCUMENTS

| | | | | | |
|---|---|---|---|---|---|
| 6,058,952 | A * | 5/2000 | Lin | A45B 25/22 | 135/23 |
| 6,089,244 | A * | 7/2000 | Ko | A45B 25/02 | 135/29 |
| 7,407,178 | B2 * | 8/2008 | Freedman | A45B 11/00 | 135/20.3 |
| 7,523,759 | B2 * | 4/2009 | van Loosbroek | A45B 19/00 | 135/21 |
| 9,204,695 | B2 * | 12/2015 | Van Loosbroek | A45B 19/00 | |
| 2004/0211451 | A1 * | 10/2004 | Goh | A45B 25/20 | 135/31 |
| 2015/0245691 | A1 * | 9/2015 | Fitzgerald | A45B 19/00 | 135/27 |

FOREIGN PATENT DOCUMENTS

| | | | | | |
|---|---|---|---|---|---|
| EP | 2443956 | A3 * | 11/2012 | A45B 19/00 | |
| FR | 2681224 | A1 * | 3/1993 | A45B 19/00 | |
| GB | 481001 | A * | 12/2011 | A45B 9/02 | |

* cited by examiner

DEPLOYABLE SHADING STRUCTURE

BACKGROUND

1. Field of the Description

The present invention relates, in general, to methods and devices useful for providing protective shading from the Sun and, more particularly, to a system or assembly for selectively deploying a shading structure that is designed to create shade when needed and to hide the shading structure when shading is not needed or desired (e.g., to remove shading structures to enhance a sightline to a parade/show, to allow viewing of the sky/stars and/or to insert the shading structure into a space to modify the sightlines or enhance a theatrical show or provide theming for a space).

2. Relevant Background

There are many applications and situations where it is desirable to provide people weather protection including protection or cover from rain and shading from sunlight. For example, it is desirable to provide shading for visitors of theme and amusement parks, stadiums, city parks, and outdoor malls, especially in the heat of the summer, to make their visit to the park a more enjoyable experience and to encourage the visitors to stay at the park even during the sunniest and hottest portions of the day.

To provide shading and protection from rain, numerous solutions may be implemented. In many settings, each visitor may simply be provided with an umbrella to carry with them and use when needed for shading or cover from the rain. Larger umbrellas may also be set up in some spaces such as to provide shading and cover over an outdoor table. In other situations, buildings and other structures may be equipped with a fixed or selectively deployable awning that extends from an outer surface to provide a place where people can go to find weather protection. In some settings, large spaces can be covered with a roof with a desired amount of sun blocking abilities. Instead or in addition to these devices, trees may be planted throughout a facility and may be selected for their ability to provide shading from sunlight.

One challenge for operators of public spaces or facilities (such as theme and amusement parks) is how to create a unique and fun atmosphere while still providing weather protection. For example, it is desirable in many spaces to provide many clear sightlines to parade routes, to stages where entertainers provide a show, and to otherwise maintain the feel that the visitors are outside in a new land. The above solutions for providing weather protection often do not meet the needs of park operators. Trees block sightlines, require ongoing and significant upkeep, and are fixed in size and shape. Umbrellas have to be manually and individually deployed. Awnings are fixed to a very specific location and require the people seeking protection to stand very near to the building or structure where the structure itself limits sightlines. Roofing is difficult to implement without causing the visitors to feel like they are enclosed and typically will block many views.

SUMMARY

The inventors recognized that none of the existing weather protection devices meet all the needs and demands of operators of larger facilities, including theme and amusement parks, where visitors spend large amounts of their time outdoors. The inventors determined that in contrast to existing devices it would be desirable for a new weather protection device to provide shade when shading is needed or desired, for the device to be hidden or blend in with surrounding architectural features when no shading (or weather protection) is needed or desired, and for the weather protection device to be designed to enhance a show and/or to have a theme-based appearance or characteristics.

With this in mind, a deployable shade structure system was created that can be installed at nearly any desired location. The system includes a flexible canopy that can be deployed when shading is desired or needed and can also be fully retracted so as to be wholly hidden from view within an enclosure or housing. The canopy, in some embodiments, is formed of a material with pores or mesh-like openings sized and shaped so that the canopy is at least partially air and water permeable so that the canopy does not behave like a sail or kite. The canopy may be circular, square, or some other shape, and, when deployed, may generally be shaped as an upward facing cup or saucer (or upward facing flower) with each of its web segments (e.g., portions of the canopy extending between support ribs or arms) having an arched or arcuate shape when viewed from the side from the center of the canopy to the outer edges.

The deployment may be full or partial so as to control the amount of shade, the shape and size of the canopy outside of the enclosure, and the sightlines of people nearby. Deployment and retraction may be sensor driven to trigger deployment/retraction based on presence of people (no shade needed if no people nearby), presence of sunlight (no shading needed if not sunny or, in some cases, if not above a certain temperature), presence of rain, and the like. The system includes a deploy and retract assembly that may be manually operated or triggered by a human operator or, more typically, that may be automated to operate (e.g., operate a drive to move the canopy and its supports out of the enclosure or back into the enclosure) in response to data from the sensors or to synchronize operation of the system with outer facility systems (e.g., to synchronize retracting and deploying with a show or parade such as to retract to provide unobstructed sightlines during the show or parade or to deploy only during the show or parade to provide theming or background features for the show or parade).

More particularly, a system is described herein for providing weather protection including shading in an automated and selective manner. The system includes an enclosure with an inner chamber and an outlet to the inner chamber. The system also includes a canopy and a deploy and retract assembly, which includes a canopy support assembly supporting the canopy. The deploy and retract assembly operates to move the canopy support assembly to move the canopy into the inner chamber and out of the inner chamber. The system further includes a controller generating control signals to operate the deploy and retract assembly. Specifically, this assembly is configured to retract the canopy by moving the canopy support assembly to move the canopy through the outlet into the inner chamber and further is configured to deploy the canopy by moving the canopy support assembly to move the canopy through the outlet to be at least partially outside of the inner chamber.

In some implementations, the controller operates the deploy and retract assembly to position the canopy in a full deployment stage with the canopy having a first outer diameter and in an intermediate deployment stage with the canopy having a second outer diameter less than the first outer diameter. In such implementations, the canopy is positioned wholly within the inner chamber when retracted by the deploy and retract assembly, whereby the canopy is hidden from view. The system may further include a sensor providing sensor data to the controller, and the controller processes the sensor data (e.g., compares the sensor data with predefined trigger values for one or more parameters). In response, the controller triggers the retracting or the deploying of the canopy by operating the deploy and retract assembly. The sensor may be chosen to sense at least one of rain, temperature, and motion in a predefined area about the enclosure. To implement the system, the canopy typically will be provided as an assembly of sheets of material with a predefined porosity, whereby the canopy is permeable to water and air and filters light without being opaque (e.g., with a mesh or mesh-like material with 10 percent or less porosity or the like).

The canopy support assembly may include a plurality of ribs coupled with the canopy in a spaced apart manner. In such embodiments of the system, each of the ribs is configured to have a first stiffness in an inner section and a second stiffness less than the first stiffness in an outer section. For example, the inner section may be a metal rod (with a single OD along its length or a tapering may be utilized from the inner to outer end) and the outer section may be a tapered rod with a first end attached to the metal rod and having a first outer diameter and a second end distal to the first end and having a second outer diameter less than the first outer diameter. The tapered rod may be formed of a plastic, a fiberglass, a graphite, or a combination of these or other materials.

The canopy support assembly may be implemented using a lower hub, an upper hub spaced apart from the lower hub, a first set of ribs with a first length, and a second set of ribs with a second length less than the first length. In such implementations, each of the ribs of the first set can be pivotally coupled at a first end to the lower hub and are coupled to the canopy, and each of the ribs of the second set are pivotally coupled at a first end to the upper hub and at a second end to one of the ribs of the first set. In the same or other embodiments, the outlet of the inner chamber may be a conical-shaped support with an inner surface with an angle offset from a central axis of the inner chamber in the range of 15 to 60 degrees, whereby a portion of the canopy support assembly (e.g., the inner section of each of the long ribs that are coupled to the canopy) is supported on the inner surface when the canopy is deployed.

BRIEF DESCRIPTION OF THE DRAWINGS

FIGS. 2 and 3 illustrate an exemplary deployable shading structure system which may be used to implement the system of FIG. 1, with FIG. 2 showing the canopy in a fully deployed state (or full deployment stage) in relatively still air while FIG. 3 shows the canopy of FIG. 2 when exposed to wind with the air-permeable or porous fabric provided in the webs of the shading structure or canopy being porous (e.g., include a mesh material that passes some light (not wholly opaque due to porosity and passes some air through its hole/pores so not like a parachute, sail, kite, or the like);

FIG. 4 illustrates three of the deployable shading structure systems as shown in FIGS. 2 and 3, with each in a different stage of deployment (or different operating state) as may be triggered in response to received sensor data, in response to operator manual control inputs, in response to playing of a canopy deployment/retraction program, or the like;

DETAILED DESCRIPTION

Briefly, the present description is directed toward a deployable shading structure system (and corresponding shading method) adapted to be deployed and retracted in an automated (non-manual) manner on demand or in response to sensor data. Deployment may be full or may also be partial to control the amount of shading (or other weather protection) provided by the system's shading structure (e.g., a flexible canopy supported by an assembly of ribs/arms) and/or to choose the size and/or shape of the shading structure (e.g., to provide a smaller area of shade, to achieve a desired sightline, to enhance a theme or look and feel of a space and so on). In the fully retracted state (or first deployment stage or default operating state) of the system, the shading structure/supported canopy is positioned within an enclosure.

The system was created to be particularly well suited for use in open spaces like those found in theme and amusement parks, which would also make the system well suited for areas like outdoor malls, sports parks/facilities, and the like while others may wish to use the system in city parks and even for residential applications. One implementation (a non-limiting example) of the system was configured based on the following structural preferences: (1) be have a hiding enclosure/housing with an outlet for the canopy that was between 9 and 15 feet above the ground so as to not block walkways and human traffic; (2) to project a shadow with a 12-foot radius (or to have a similar shade area if non-circular in shape; in practice, the radius is chosen relative to the size of the canopy or veil and is not limited in overall size); (3) to be easy to operate and maintain; (4) to increase comfort and safety of visitors to a space including the system; (4) to be autonomous, passive, and/or self-powered; (5) to be portable and retractable (e.g., to not block view of fireworks or other shows); (6) to be immersive and magical (e.g., seamless to the facility's theme or experience); and (7) to be resilient, repeatable, and adaptable. Additionally or alternatively, the system may be configured based on the following creative criteria: (1) be unusual, unexpected, and delightful to visitors; (2) to provide a spectacle during deployment and/or retraction (e.g., based on scale, speed, or other parameters); (3) to appear to be a part of nature or to be alive (e.g., to be in motion when idle such as to move in a flowing manner with a wind or breeze); (4) to be responsive to peoples such as to have its deployment or retraction triggered by people to promote play or to surprise/entertain the people nearby; and (5) to have a variety of operational triggers such as a person within a predefined distance or at a particular location relative to the enclosure/housing, a temperature, an amount of sunlight, a timer, and so on.

Figure 1:
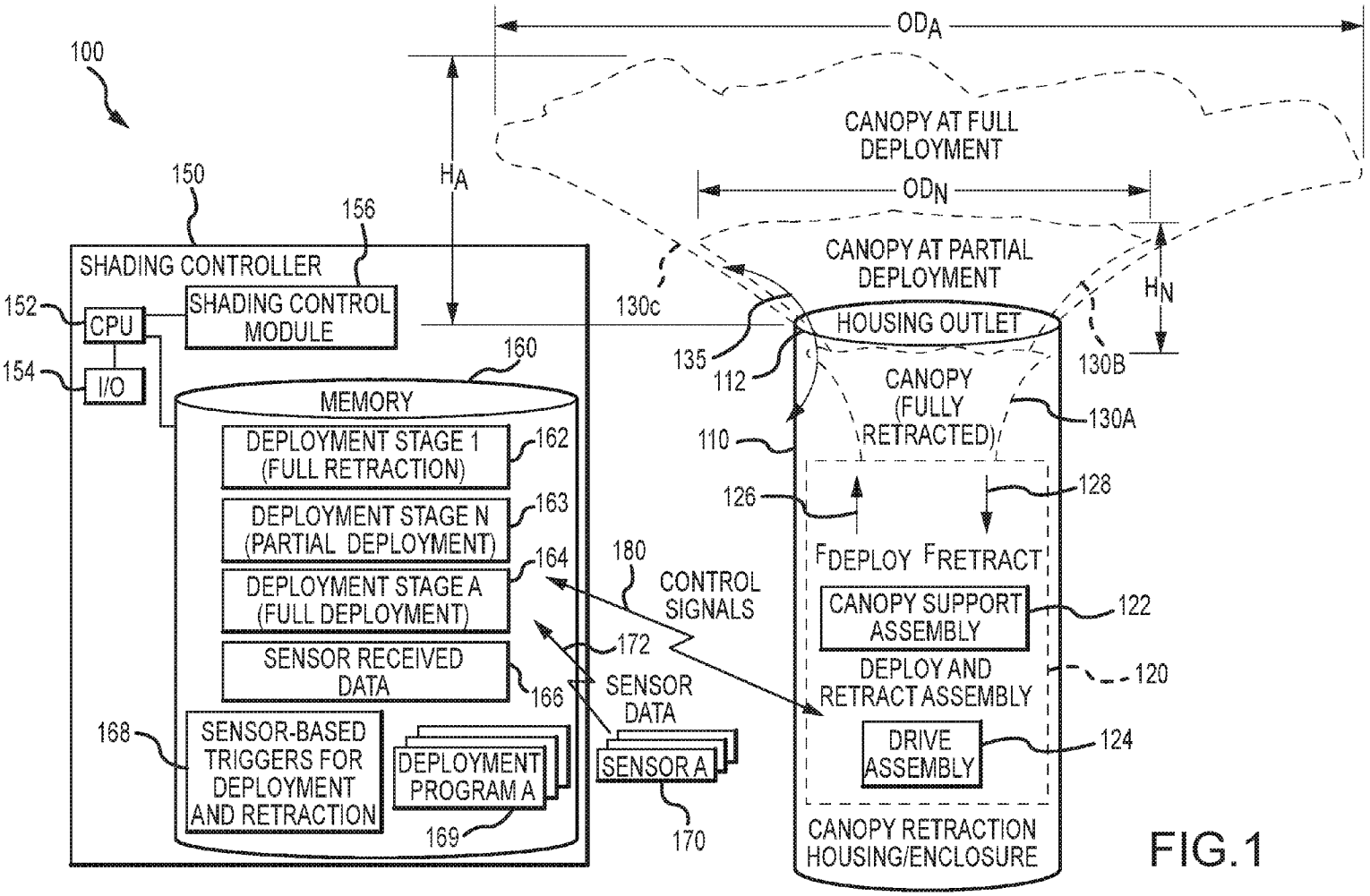
FIG. 1 is functional block diagram of a deployable shading structure system including at least a subset of the unique shading and entertainment concepts described herein.

FIG. 1 is a functional block diagram of a deployable shading structure system 100 of the present description. The system 100 is configured for selectively retracting and deploying a shading structure that may take the form of a flexible canvas or canopy (shown at 130A in a retracted state, at 130B in a partially deployed state, and at 130C in a fully deployed state). As shown, the system 100 includes a canopy retraction housing or enclosure 110 adapted to receive (typically wholly or nearly so) the canopy 130A when it is retracted so as to hide the canopy 130A from view when it is not in use (e.g., no shading is required or desired). An outlet (or opening) 112 is provided at an upper or top end of the enclosure 110 through which the canopy/shading structure can be moved during retracting and deploying operations as can be seen with the partially deployed canopy 130B. The enclosure 110 may take many forms such as a hollow circular tube or cylinder (or a tube/cylinder with a triangular, square, or other polygonal cross-sectional shape or even an irregular cross-sectional shape may be used) formed with a metal, plastic, or other material sidewall(s) with an open end to provide the outlet 112 and the other end supported by a base (not shown in FIG. 1) or other structure when mounted vertically or at an angle. The height of the housing 110 (or to the outlet from the ground) may be any useful height with some embodiments of system 100 using a height of 9 to 15 feet (or more) to avoid the deployed canopy 130B, 130C blocking traffic or contacting nearby people using shade provided by the system 100. The inner diameter of the housing 110 is selected to provide space for receiving the canopy 130A and also any support elements for the canopy 130A and devices used to retract and deploy the canopy 130A-130C.

The system 100 further includes a deploy and retract assembly 120 that may be partially or wholly contained within the interior of the enclosure 110. The assembly 120 includes a canopy support assembly 122 that functions to support and position the canopy 130A-130C in the retracted position as well as throughout deployment from the enclosure 110. The canopy support assembly 122 may include a plurality of support ribs or arms that are spaced apart and each extending outward from a center portion of the canopy 130A-130C to its outer edge(s), with the fabric of the canopy 130A-130C being attached to these ribs/arms (e.g., such that the fabric or material of the canopy may slide or pivot relative to the nearby surfaces of the ribs/arms). Each of ribs/arms may be pivotally supported at a first (inner or lower) end and have its second end at or near the outer edge of the canopy 130A-130C so that the canopy 130A may be folded or compressed in upon itself during retraction (e.g., with the ribs/arms extending parallel or at a smaller angle to vertical to the central axis of the interior chamber or space of the enclosure 110) and then have its outer tip or end rotate downward toward the ground as the canopy is deployed through states (as shown in partial deployment stage at 130B) to full deployment as shown at 130B (e.g., such that each rib/arm is at an angle from vertical such as up to about 90 degrees at full deployment or in the range of 40 to 70 degrees being common at full deployment of the canopy 130C). In other embodiments, full deployment may be provided at an angle greater than 90 degrees or less than 40 degrees may be utilized.

The deploy and retract assembly 120 includes a drive assembly 124, e.g., one, two, or more electric motors along with components driven by these motors to move the canopy 130A-130C into the chamber of the enclosure 110 and out of the enclosure 110 through the outlet 112. The drive assembly 124 is operated by control signals 180 from a shading controller 150 (e.g., wired or wireless communication signals to a motor controller(s) of the drive assembly 124). During its operations, the drive assembly 124 may apply a force, $F_{Deploy}$, on the canopy support assembly 122 to push or move the canopy 130A outward through partial or intermediate deployment stages 130B (or deployment may be halted and held in such stages 130B) to a full deployment stage 130C (which may be held for a period of time to provide shading or theme-based entertainment). When operated (via signals 180) to retract (or move back to a first deployment stage), the drive assembly 124 may apply a force, $F_{Retract}$, on the canopy support assembly 122 to pull or move the canopy 130C through intermediate deployment stages as shown at 130B and through the housing outlet 112 to the fully retracted stage as shown at 130A. With arrow 135, movement and expansion (or unfurling or unfolding) of the canopy and then later compression (or furling or folding) is shown.

The outer diameter of the canopy 130A when fully retracted is typically about the same as the diameter of the chamber within the enclosure 110 or some amount less. The outer diameter, $OD_N$, at the intermediate or second deployment stage of the canopy 130B is greater than the diameter of the outlet 112 as the support assembly 122 allows the canopy 130B to open or unfurl with increasing height, $H_N$, and the outer diameter, $OD_N$, of the canopy 130B may be a fraction of its largest diameter, $OD_X$, at full deployment as shown at 130C (which may be a ratio of the two height, $H_N$ and $H_X$, of the canopy 130B and 130C (such as half the $OD_X$ when the $H_N$ is half of $H_X$) but this will depend on the configuration of the canopy support assembly 122). The canopy at the second or intermediate deployment stage 130B and at the third or final deployment stage 130C may be generally bowl or saucer shaped with the opening of the bowl or saucer facing upward, which is a shape that mimics many plant shapes such as upward facing flowers and many trees (such as palm trees and the like), but, in other embodiments, the canopy may have a variety of other shapes at full and partial deployment. Further, as explained below, the web section or webbing between each rib or arm in the support assembly 122 of the canopy 130B and 130C may be arched or arcuate in shape (e.g., initially rising upward from the central axis of the canopy and then sloping downward toward its outer edge/side as each cantilevered rib/arm be chosen to be flexible and not rigid and may bend under the weight of the canopy).

The system 100 further includes a shading controller 150 that functions to generate and communicate the control signals 180 (as discussed above). The controller 150 may take the form of a computer or computing device with a processor 152 that manages operations of input/output (I/O) devices 154 (e.g., a wireless transceiver for communicating the signals 180 and receiving sensor data 172 in a wired or wireless manner, a keyboard or touchscreen or the like for allowing a human operator to manually trigger or generate the control signals 180, and the like). The processor 152 further executes code or instructions (e.g., software or programs) to provide a shading control module 156, which is configured to process sensor data 172 and other information and selectively generate the control signals 180. The controller 150 also includes memory 160 that is managed and accessed by the processor 152 such as during running of a program to provide the shading control module 156.

The memory 160 is used to store a set of deployment stage definitions 162, 163, 164 that are used to generate the control signals 180 to cause the drive assembly 124 to move the canopy into a desired state or stage or deployment/retraction. For example, the first deployment stage 162 may correspond with full retraction as shown at 130A, the second or intermediate deployment stage 163 may correspond with an intermediate or partial deployment as shown at 130B, and the third or final deployment stage 164 may correspond with a full deployment as shown at 130C from the enclosure 110. The control signals 180 are used to operate the drive assembly 124 (e.g., its electric motor(s)) to apply the forces, $F_{Deploy}$ and $F_{Retract}$, needed to achieve these stages/states of canopy deployment or retraction. The shading control module 156 may select the stage 162-164 based on a deployment program 169 such as based on a timer (deploy or retract the canopy at certain times of day such as to open and provide shade during daylight hours and close during the night) or to move into or through the deployment stages 162-164 in synchronization with other systems such as to provide themed background for a show (and in some embodiments, light (video or colored light) is projected onto the upper or lower surfaces (or both) of the canopy) or to retract to provide enhanced sightlines to an aerial or other type of show or form of entertainment.

The system 100 is also shown to include one or more sensors 170 that operate to collect data about the environment around the enclosure 110 and to pass/communicate this sensor data 172 to the controller 150 for storage (as shown at 166) and processing by the shading control module 156. This processing may include comparing the sensor data 166 to a set of sensor-based triggers 168, which define when operation of the deploy and retract assembly 120 should be triggered with control signals 180 and to which deployment stage 162-164 the canopy should be moved (e.g., to stage 130A, stage 130B, or stage 130C as shown in FIG. 1).

The sensors 170 may take a wide variety of forms to implement the system 100. A light sensor may be used in the system 100 and the defined trigger 168 may be an amount of light such that the assembly 120 may be operated to retract the canopy to stage 130A when there is no or little light, to deploy the canopy to stage 130B when there is partial sunlight (or some amount between dark and full sunlight), and to deploy the canopy to stage 130C when there is full sunlight or an amount of light greater than a predetermined value (as defined in trigger definitions 168). The sensors 170 may include a motion detector, and the shading control module 156 may be adapted to cause the canopy to be moved into full retraction 130A when there are no people (or anything) moving in the area about the enclosure 110 for a predefined time period or to one of the deployment stages 130B or 130C when motion is detected near (e.g., within 10 to 30 feet (or more) of the enclosure 110). The sensors 170 may include a thermometer and a trigger definition may be temperature points or ranges to provide one of the deployment stages 162-164 (e.g., retract when cooler and deploy further and further with rising temperatures). The sensors 170 may include a moisture sensor (rain detector), and deployment to one of the stages 163 or 164 (as shown at 130B and 130C, respectfully) may be triggered by module 156 when it is raining to provide weather protection for people near to the enclosure 110.

Figure 2:
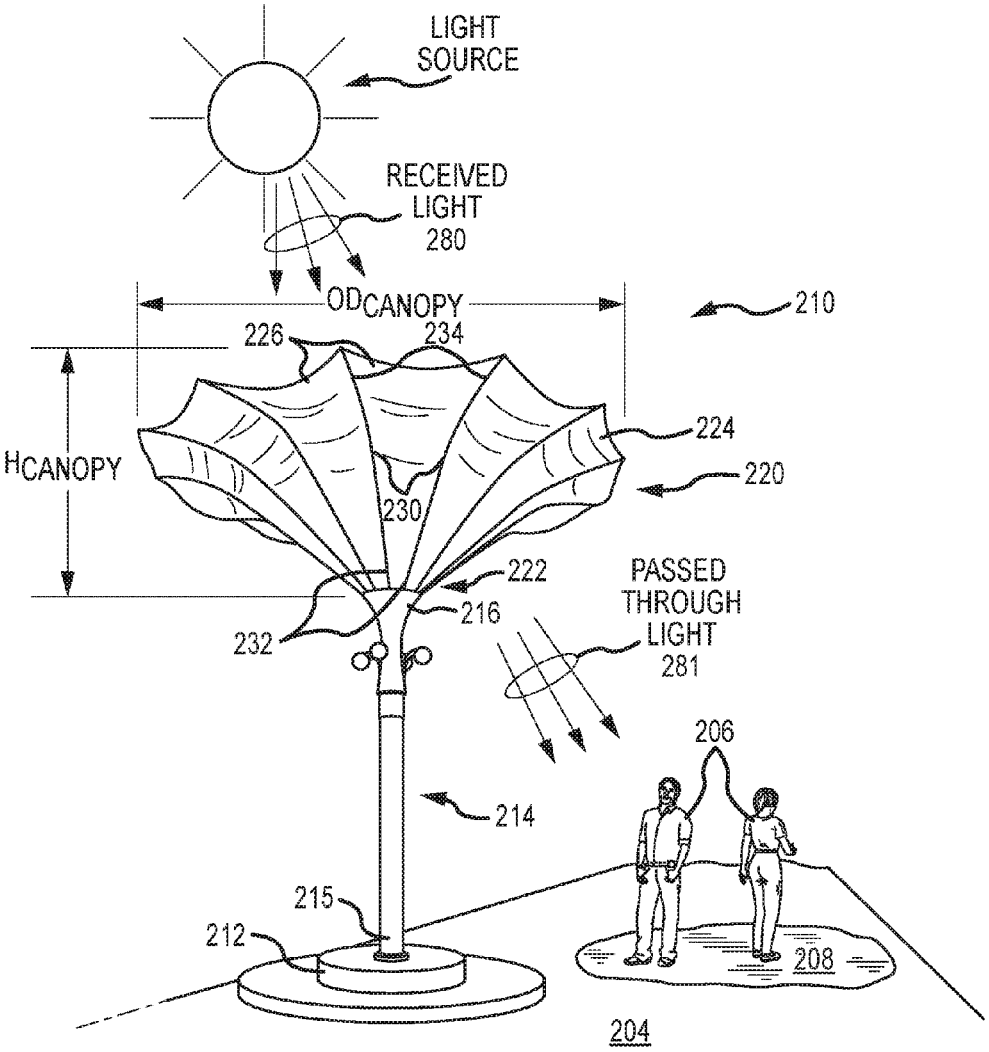

FIG. 2 illustrates an embodiment of a deployable shading structure system 210 in the fully deployed stage of operations. As shown, the system includes a base/platform 212 that is supporting a vertically arranged canopy enclosure or housing 214. The enclosure 214 is an elongated tube with a circular cross sectional shape, with a first end affixed to the base 212 and a second opposite end 216 configured to be open (not capped, although some embodiments may have a pivotally-mounted cap or sliding cap that can be moved out of the way during deployment and moved back into a covering position upon full retraction of the canopy or shading structure 220) to provide an outlet/opening to the interior chamber of the enclosure 214. In this embodiment, the end 216 is cone shaped to provide a non-vertical or outwardly angled support surface for the lower end of the canopy 220 and its supporting ribs/arms 230 during deployment (e.g., each rib/arm 230 is cantilevered from the inner surface of the conical end 216 of the enclosure 214). The height of the enclosure as measured from the lower edge of the base 212 to the outer edge of the end 216 may vary to practice the system 210, with a height in the range of 9 to 15 feet being preferred in some settings. Note, the enclosure may be wholly or partially underground or below a structure/platform used to hide all or a portion of the enclosure.

The system 210 includes a canopy 220, which may take the form of a circular sheet of material (with "sheet" in some cases being an assembly of two-to-many sections of material or sheets of material combined to provide an assembly or larger sheet) that is mesh or has pores to be permeable to air (and, to some lesser extent, water) so that the canopy 220 does not behave like a sail or kite. The canopy support assembly of system 210 includes a plurality of spaced apart ribs or arms 230 with first ends 232 pivotally supported within by a plate or hub (not visible in FIG. 2) within the enclosure 214 or at the opening of the end 216. The second end or tip 234 of each elongated rib/arm 230 is attached in a fixed or pivotal manner to the outer edge 224 of the canopy 220 while the inner edge 222 of the canopy 220 may be coupled with the first ends 232 of the ribs 230 (or to the plate/hub in some cases or to each rib 234 near the first end 232).

The canopy 220 is formed of flexible and relatively thin material to allow it to be compressed or folded in on itself during retraction and to be expanded out to its full (or a fuller) area at full deployment as shown in FIG. 2. A web or webbing segment 226 is formed between each of the ribs 230 and as can be seen the first ends 232 of the ribs are closer together (less spacing) at full deployment than the second or outer ends 234 (more spacing). As will be explained in more detail below, each of the ribs 230 is a rod or shaft fabricated of a flexible material such that each rib has a desired amount of shaft flex (or rod action). In some embodiments, each rib 230 has a larger diameter at its first/inner end 232 than at its second/outer end or tip 234 so that the rib 230 has more and more flex or action as one moves along its length from the first end 232 to the second end or tip 234.

Also, each rib 230 may be designed to be flexible (and in some cases, very flexible) throughout the entire length of the rib 230 (while it may be more stiff (less flexible) at the first or inner end 232 and have less stiffness in its outer portions such as outer half, outer third, outer quarter, or the like that may be 30 to 50 percent (or more) more flexible than the inner portions near the first or inner end 232. The materials may vary with some ribs being formed of a metal while other are formed of graphite, fiber glass, and other materials (e.g., the materials used to provide flex in fishing rods) while some ribs are formed of a combination of such materials such as a metallic inner portion (e.g., first quarter to half of the rib 230 may be formed of a metal rod to provide greater stiffness or less flex while the second three quarters to half may of the rib may be fiberglass, graphite, or the like (or some combination of these materials) so as to have less stiffness or more flex than the inner portion).

The fully deployed canopy 220 has an outer diameter, $OD_{Canopy}$, that provides shading/blocking of light 280 from a light source (e.g., the Sun) to create a shaded area 208 in which people 206 may position themselves to receive protection from the Sun's rays. The outer diameter, $OD_{Canopy}$, can be chosen (e.g., 10 to 30 feet in some embodiments) to size the shaded area 208. The material of the canopy 220 can be chosen to block all or nearly all received light 280 or, as shown, to allow some fraction of the light 280 through as shown at 281 such as due to its porosity (the pores or mesh openings in the material) in each web 226 (e.g., block 50 to 100 percent of the light 280).

Figure 3:
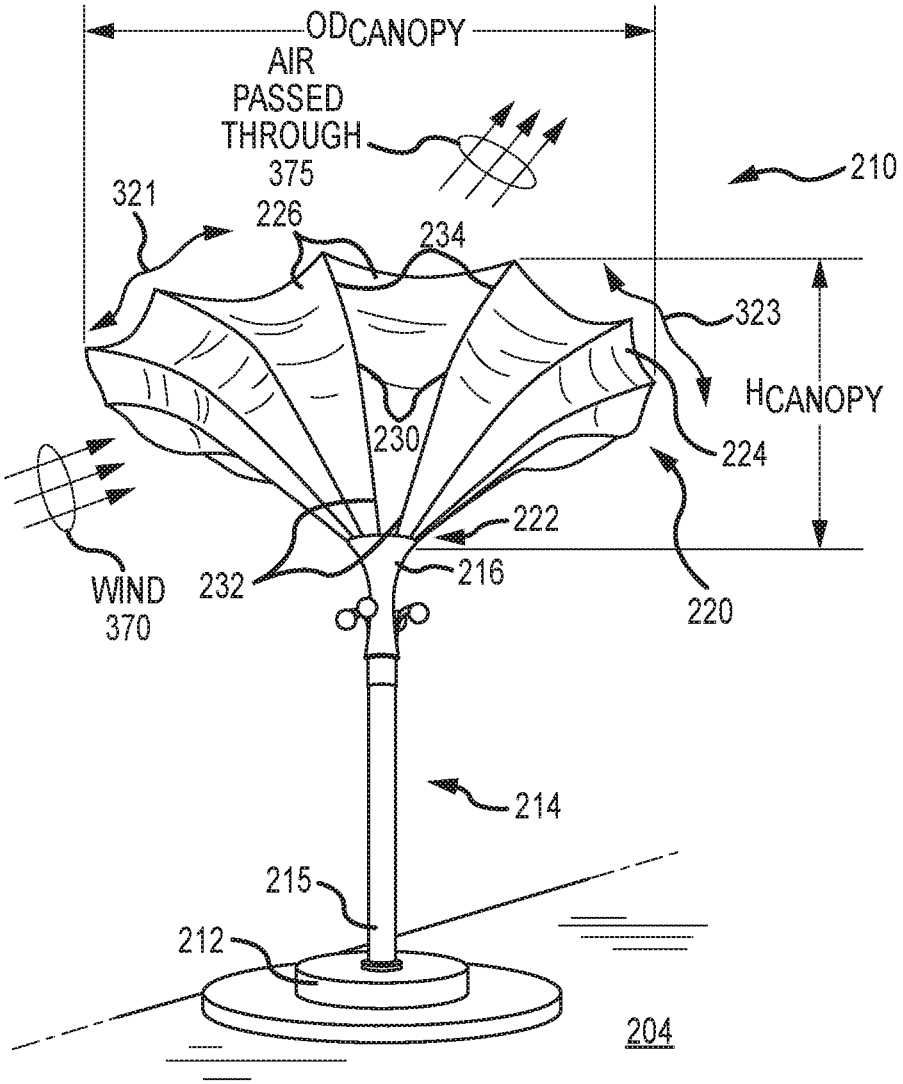

FIG. 3 illustrates the same deployable shading structure system 210 when the deployed canopy 220 is exposed to a breeze or low wind as shown with arrows 370. The material of the canopy 220 is chosen to be flexible and the ribs 230 also have some rod action or staff flex so that the canopy 220 moves in response to the wind 370 as shown with arrows 321, 323 such as moving a first direction with a gust of wind 370 and then bouncing or flexing back into or toward its original shape (of the webs 226 and ribs 230). In contrast to conventional shade devices, this movement 321 and 323 is achieved through the use of the flexible ribs 230 while the porosity (e.g., 1 to 20 percent porosity provided by small pores/holes/openings in the mesh-like material of the canopy 220) does not overstress the canopy 220 or enclosure 214. The canopy 220 appears to be breathing or to be swaying in the wind 370 as it moves from a first shape and size to a second shape and size (which differs from the first shape and/or size), which is desirable in many themed applications. This changing shape and/or moving canopy 220 also causes the shaded area 208 to change its shape, size, and/or location (at least to some extent).

Figure 4:
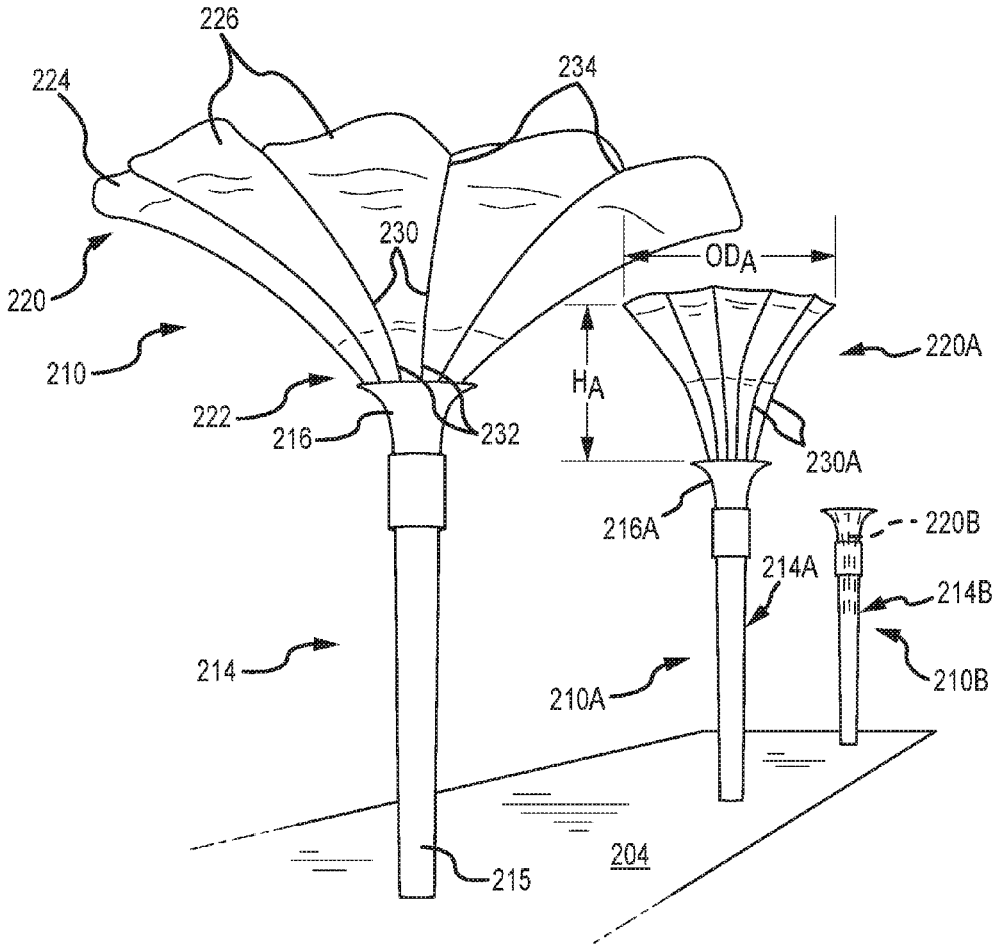

FIG. 4 illustrates the system 210 in its fully deployed operating state (or deployment stage). Alongside the system 210, additional deployable shading structure systems 210A and 210B are shown that have a matching design but are operated to be in two different operating states (or deployment stages) As shown, the system 210B is in a fully retracted operating state (or a deployment stage corresponding with a retracted canopy). In this operating state, the canopy (not visible) is wholly retracted into the enclosure 214B, and the system 210B provides no shade or weather protection. In contrast, system 210A is in an operating state (or deployment stage) in which the canopy 220A is at an intermediate deployment (or in a deployment stage between systems 210B and 210). In this operating state, the canopy 220A supported on ribs 230A is part way out of the opening in end 216A of the enclosure 214A. This causes the canopy 220A to have a different height, HA, than canopy 220 of system 210 and also a different shape (e.g., more cup or tulip-like in shape than the shallower cup or saucer-like shape of canopy 220 of system 210, which is fully deployed). The ribs 230A are closer together at their second or outer ends such that the webs or web segments are smaller in area. In this deployment stage, less shading is provided (shaded area is smaller) and the sight lines are generally larger or more clear (which may be useful to allow viewers to see a show or to direct viewers' attention to some object or activity behind the canopy 220B that may be blocked from sight by full deployment).

Figure 5:
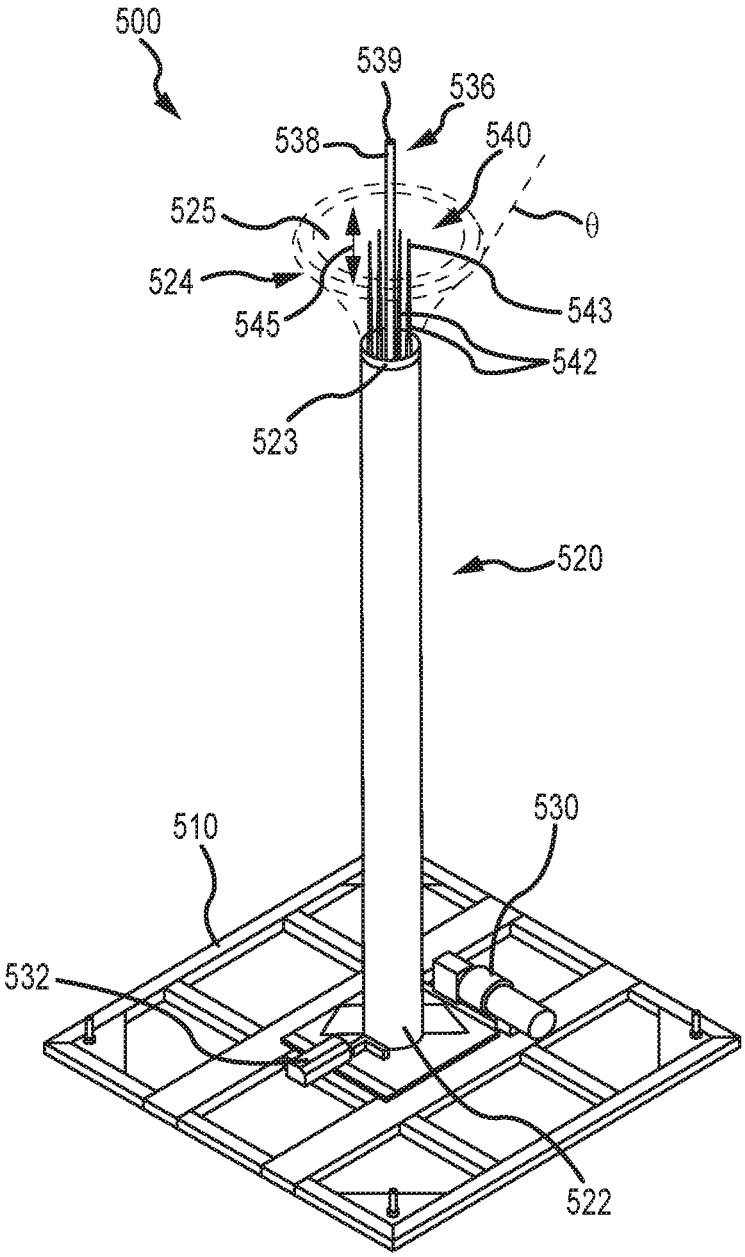
FIG. 5 illustrates a perspective upper side view of a deployable shading structure system of the present description with the canopy removed (or not yet mounted) on the ribs of the deploy and retract assembly to more clearly show the components of this assembly and their operations and with the assembly in the fully retracted position (or first deployment stage of the deploying and retracting assembly)

At this point in the description, it may be useful to more fully discuss one useful (but not limiting) example of how these concepts may be successfully implemented to provide shading structure that can be deployed and retracted in an automated (e.g., motorized) manner rather than requiring manual processes. FIG. 5 illustrates a perspective view of a deployable shading structure system 500 that was designed and prototyped by the inventors. The system 500 includes a base/platform 510 that is used to support a canopy enclosure or housing 520, with the first or lower end 522 of the housing 520 affixed to the base 510 and a second opposite end 523 distal to the base 510. The enclosure 520 is tubular in shape and arranged vertically with its central axis (shown as $Axis_{Central}$ in FIG. 6) orthogonal to the base's upper surface. Again, its height may be varied with a height of 9 to 15 feet or more being useful in some cases, while in other cases all or a portion of the enclosure 520 may be underground or below a structure/platform to partially hide its presence, for example. In other envisioned embodiments, the enclosure 520 may be arranged at an angle from vertical such as up to a 60 degree offset or the like to provide a desired location and/or look and feel for a deployed shading structure or to provide a desired shading effect.

The base 510 is also used in this example system 500 as a support for a pair of drive motors 530, 532 that are provided as part of a drive assembly of the system's deploy and retract assembly (as discussed with reference to FIG. 1). The drive motors 530, 532 may be used concurrently to apply forces on the canopy support assembly to cause the canopy (and its support rib assembly) into the enclosure 520 during retracting and out of the enclosure 520 during deployment. The motors 530, 532 typically are electric motors that drive a shaft and operate in response to control signals from a shading controller (such as controller 150 shown in FIG. 1).

In the system 500, a conical-shaped support 524 is provided as the enclosure outlet at end 523. The support 524 has an inner surface 525 open to the inner chamber of the enclosure 520, and the inner surface 525 is at an angle, θ, relative to the central axis of the enclosure 520, which may be in the range of 15 to 60 degrees with 45 degrees used in one prototype. The surface 525 acts to control and define the amount of downward swing of the support ribs 542 during deployment as these ribs 542 are allowed to fall downward under gravity from the vertical arrangement required when retracted into the inner chamber of the enclosure 520. The inner surface 525 of the conical-shaped support 524 also acts as a support surface for the first or inner ends of these ribs 542 during deployment (e.g., provides an extra 6 to 24 inches or more of support surface as opposed to a point or support of an edge of the open end 523 of the enclosure 520).

The system 500 is shown without a canopy to allow a clearer view and description of the canopy support assembly, but a canopy as described with reference to FIGS. 1-4 would typically be provided and mounted onto the canopy support assembly and its ribs 542. The canopy support assembly includes an assembly 540 of support ribs 542 that are shown in the fully retracted stage of operation of the system 500 to have their outer ends or tips (or second ends) 543 below the outer edges of the support 524. In this way, the ribs 542 and a canopy mounted on these ribs 542 are hidden from view. The ribs 542 may considered the "long ribs" of the assembly 540 as they extend from an inner section of the canopy to an outer edge of the canopy and hidden from view in FIG. 5 are other ribs that act to limit the amount of "fall" or stretch by the long ribs during deployment (and act to support the long ribs 542 when these ribs 542 are fully deployed.

A center shaft 536 is provided in the canopy support assembly and extends along the central axis of the enclosure 520 and center of the long support ribs 542. An outer end 538 of the center shaft 536 extends a distance outside the conical-shaped support 524. The shaft 536 guides travel and supports plates/hubs of the canopy support assembly (shown in later figures) in the enclosure 520 and system 520, and an end cap/stop 539 is provided at the end 538 to limit travel (or define fully deployment) of the canopy support assembly during deployment. Arrows 545 show movement of the ribs 542 during deployment and retraction driven by the motors 530, 532.

Figure 6:
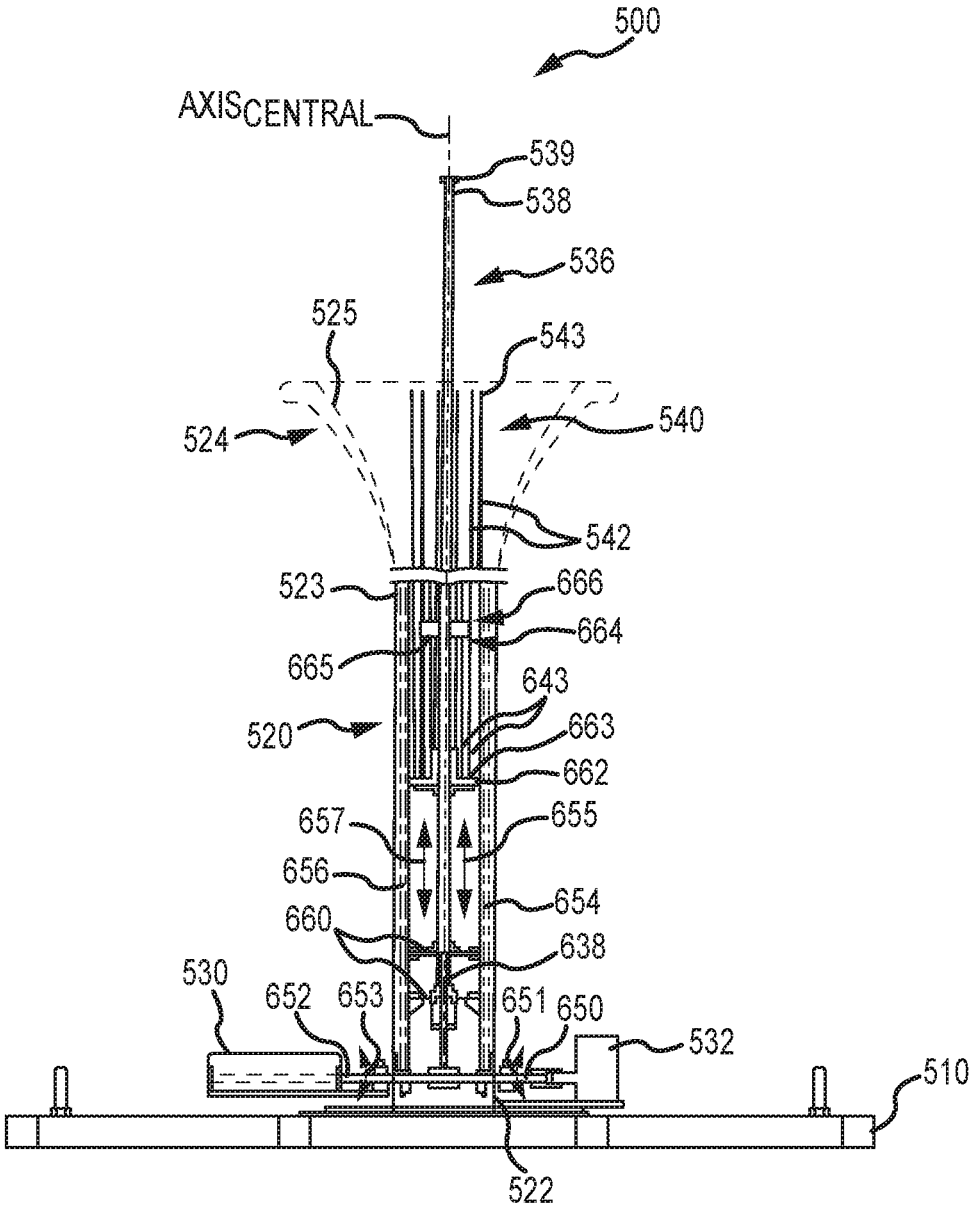
FIG. 6 illustrates a side sectional view of the deployable shading structure system of FIG. 5.

FIG. 6 is a side cross-sectional view of the system 500, which is in the retracted operating state. As shown, the motors 530, 532 are used to rotate drive shafts 650 and 652 as shown with arrows 651 and 653. The drive assembly also includes chain drives 654 and 656 within the enclosure 520, and these drives 654 and 656 are coupled (e.g., via gears or the like) to the shafts 650 and 652 such that rotation 651, 653 of the shafts 650 and 652 causes the drives 654 and 656 to raise and lower (or move linearly along the central axis, $Axis_{Central}$, and shaft 536) the canopy support assembly. The drives 654 and 656 may include chains linked to the gears coupled to the shafts or use other components such as belts and pulleys to achieve this linear motion. As shown, the drive assembly also includes a pair of drive plates or planar supports 660 that are slidingly coupled to (and supported by) the center shaft 536 via tubular collar 638 and are coupled to the linear drives 654 and 656 to linearly move (with the collar 638) with the rotation 651, 653 of the shafts 650, 652 as shown with arrows 655 and 657.

The canopy support assembly further includes a lower hub (or plate) 662 rigidly attached to or coupled with the collar 638 at a distance (e.g., 1 to 3 feet or the like) from the upper one of the drive plates, such that the hub 662 moves with the plates 660 and collar 638 over the center shaft 536. Each of the long support ribs 542 is pivotally coupled at a first or inner end 643 to the upper surface 663 of the lower hub 662. In this way, the ribs 542 (and an attached canopy) are positioned within the enclosure's inner chamber with the linear movement 655, 657 of the support plates 660 and the lower hub 662 (e.g., the ribs 542 are lifted and lowered by the lower hub 662). The canopy support assembly also includes an upper hub 664 with a lower surface 665 facing the upper surface of the lower hub 662 along with a travel stop plate 666 coupled (as explained below) to the upper hub 664. As explained below, the upper hub 664 is used to pivotally support a number of ribs that are shorter in length and used to limit fall or deployment of the long ribs 542 (e.g., these shorter ribs are each pivotally coupled at one end to the upper hub 664 and at the other end to one of the long ribs 542 such that the length of each of these shorter delimiting ribs acts to define the amount of deployment or folding out that can occur by defining the maximum or full deployment angle, β, as shown in FIG. 7).

Figure 7:
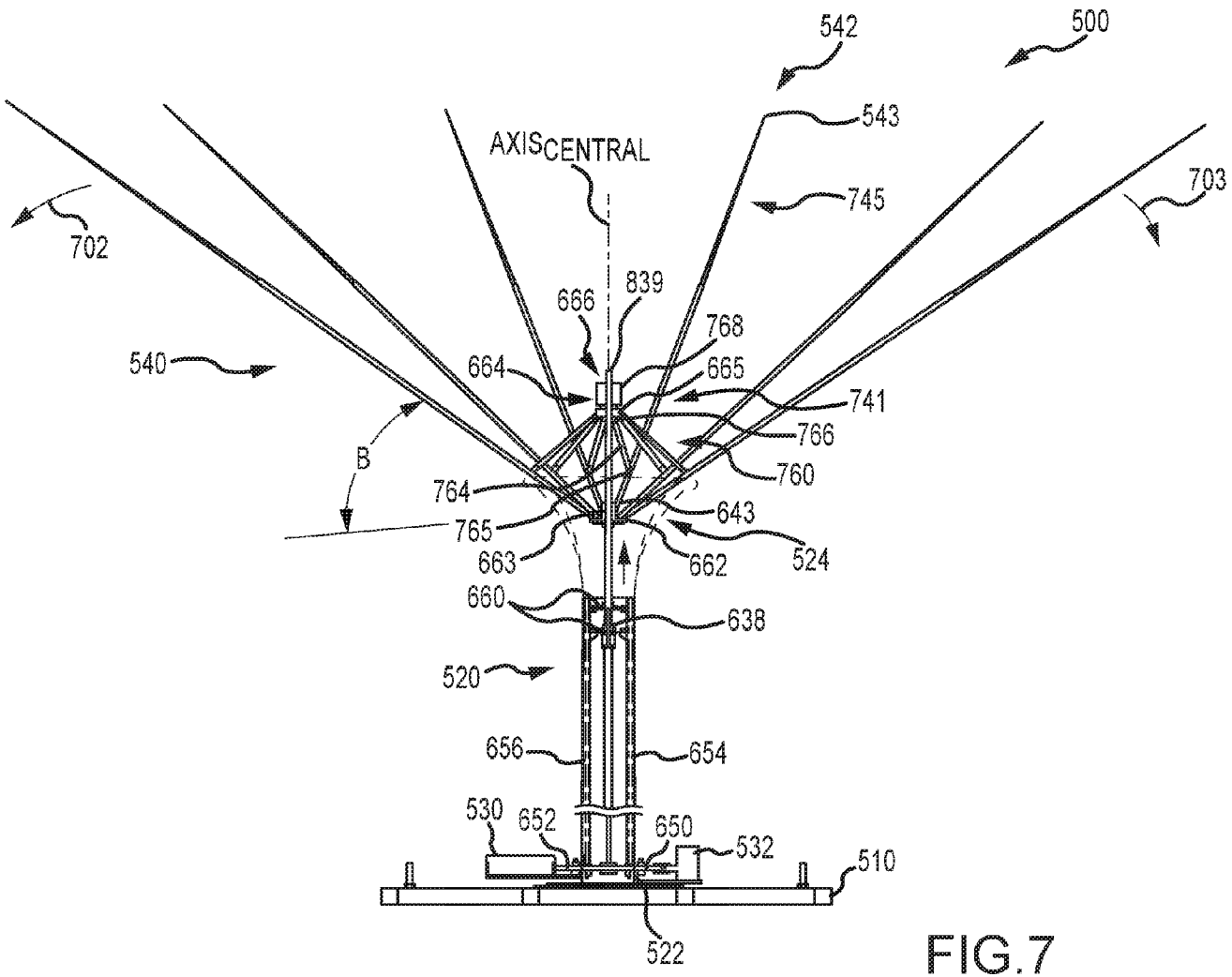
FIG. 7 illustrates, with a side sectional view, the system of FIGS. 5 and 6 after the deploy and retract assembly has been operated to moved nearly into the fully deployed position (or final deployment stage of the deploying and retracting assembly)
Figure 8:
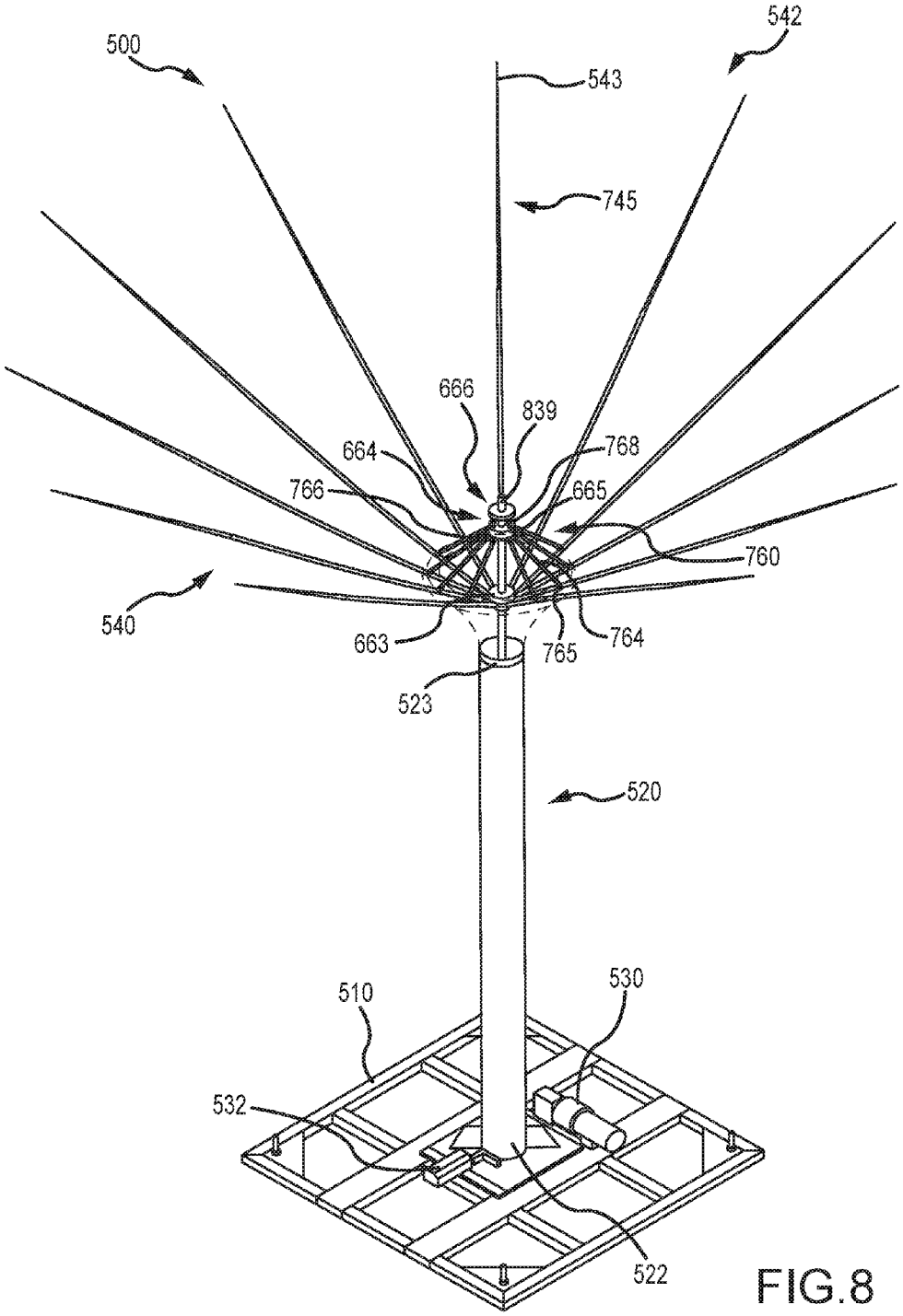
FIG. 8 illustrates the system of FIG. 7 with a perspective view showing the ribs directed upward at a deployment angle from the outlet of the canopy enclosure/housing.

FIGS. 7 and 8 illustrate the system 500 of FIGS. 5 and 6 after the motors 530, 532 have been operated to fully deploy the canopy support assembly (and, in practice, a canopy attached to its ribs 542). Arrows 702, 703 are useful for showing that the ribs 542 are allowed to expand outward and "fall" or rotate downward from the central axis, $Axis_{Central}$, running through the central shaft 536. The amount of deployment is limited by the inner surface 525 (seen in FIGS. 5 and 6) of the conical-shaped support 524 at the enclosure outlet and also by the assembly 760 of delimiting or shorter support ribs 764. As shown, the lower hub 662 has been raised to a new height that is in or near the conical-shaped support 524 (e.g., the lower hub 662 may be raised out of the enclosure 520 through the enclosure outlet at end 523). This allows each rib 542 to pivot on the upper surface 663 of the lower hub 662 as shown with arrows 702, 703.

Concurrently, the lower hub 662 moves or slides on shaft 536 toward the upper hub 664. The assembly 760 of shorter support ribs 764 as shown with rib 764 are pivotally coupled at a first or lower end 764 to one of the long ribs 542 (at some distance between the ends of that rib 542 such as closer to the lower or inner end) and at a second or upper end 766 to the lower surface 665 of the upper hub 664. In this way, each of the shorter or delimiting ribs 764 has its first or lower end 764 pulled outward from the central axis, AxisCentral, with falling/rotation of one of the long ribs 542. The shorter ribs 764 act to provide support against gravity for the long ribs 542, and the upper hub 664 is pulled downward on the center shaft 536 toward the lower hub 662. This may cause the space between the travel stop plate 666 and the upper hub 664 to grow, with the space being limited to linkage 768. This larger spacing remains until the travel stop plate 666 abuts the stop cap 539 on the end 538 of the center shaft 536. At this point, the linkage 768 pivots or accordions to allow the upper hub 664 to continue to travel on shaft 536 until it abuts the travel stop plate 666. At this point, deployment may be full or maximized or further travel (a shrinking of the gap between the lower hub 662 and the upper hub 664) causes the shorter ribs 764 to push outward or stretch the long ribs 542 into fuller deployment (which may be limited by the amount of linear travel provide by the motors 530, 532 and/or the shape of the conical-shaped support 524 and/or other design parameters).

Figure 9:
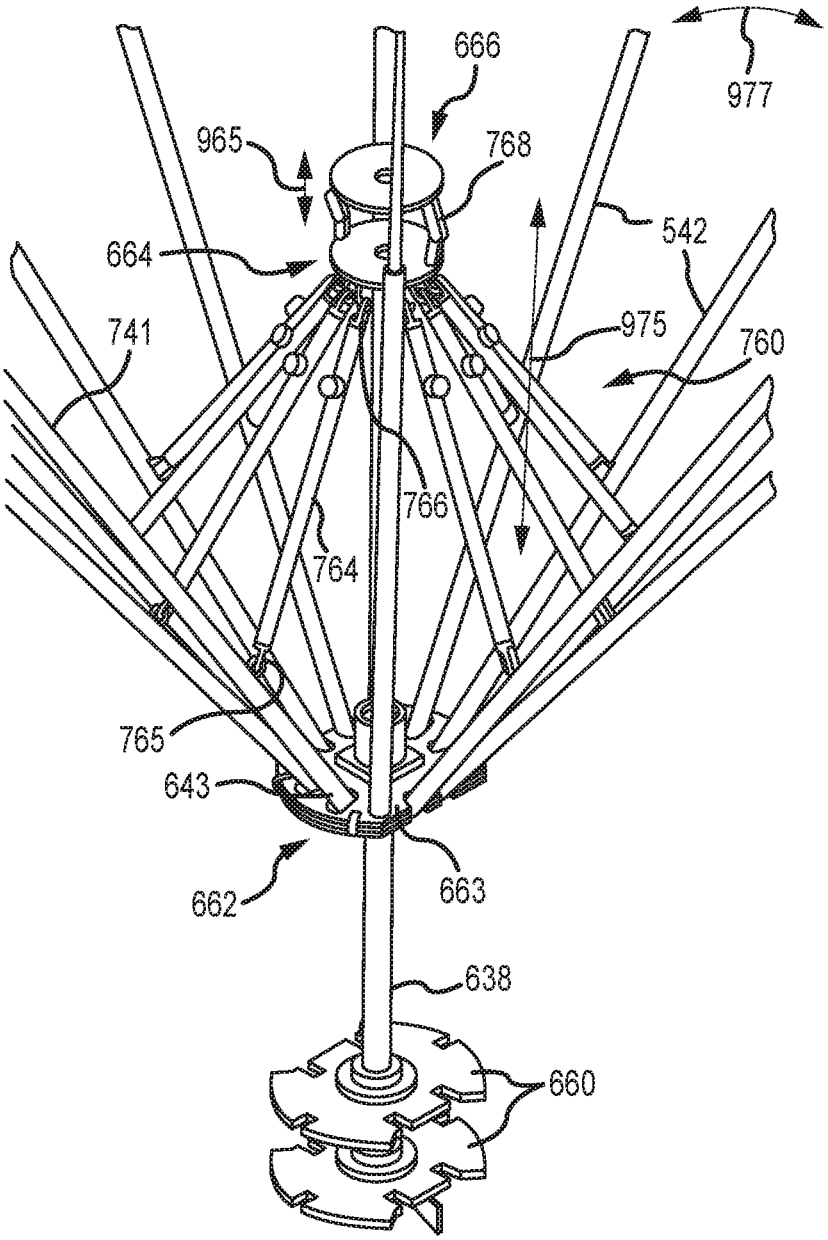
FIG. 9 illustrates a partial and enlarged view of the deploy and retract assembly showing further details of the support ribs and their pivotal coupling with upper and lower hubs.

These interactions can be seen more clearly with reference to the detailed illustration provided in FIG. 9. FIG. 9 shows with arrow 965 that the travel stop plate 766 travels with movement of the upper hub 664 due to linkage 768 until the stop cap is reached. FIG. 9 also shows with arrow 975 that each of the ribs 764 in the assembly 760 can have their outer ends 764 moved up and down with the corresponding one of the long ribs 542. Due to the arrangement of the shorter ribs 764, it can be seen that each will act to physically support one of the long ribs 542 while also limiting their travel (and, at some points in deployment, to push the long ribs 542 out into further deployment such as when the upper hub 664 is abutting the travel stop plate 766).

FIG. 7 also shows a particular implementation of the long rib 542. As discussed earlier, it may be desirable to provide a rib/arm 542 with constant stiffness or rod flex along its entire length. In other cases, though, as shown in FIG. 7, it may be useful to provide a rib 542 with stiffness or rod flex that varies along its length to provide a particular movement and support of a canopy. Particularly, it has been shown in prototyping that it is desirable to provide a decreasing amount of stiffness or greater rod flex from the inner end 643 to the outer end or tip 543. This can be achieved by using a single material with a decreasing outer diameter (e.g., a rib configured similar to a conventional fishing rod). In some cases, the rib 542 may be configured to be both flexible and stiff and not be limited to being one or the other.

Alternatively, as shown, the rib 542 may be implemented in two or more sections as shown with inner section 741 and outer section 745. The inner section 741 may be configured to have a first stiffness (or rod flex value) while the outer section 745 may be configured to a have a second (or more than one) stiffness that differs from (is less than) the first stiffness (or has a greater rod flex value than the first or inner section). In this way, the section 741 with less flex can be used to provide more support for the canopy as it is exposed to more of the weight of the canopy (greater cantilevered effect), and the second 745 with greater flex (less stiffness) can be used to support the outer portions of the canopy as it is exposed to less of the weight of the canopy. This allows the outer edges of the canopy to move more freely in a breeze/wind and also to droop more as the rib 542 may be further arched from end to end as compared to a rib 542 with constant flex/stiffness along its length.

Figure 10:
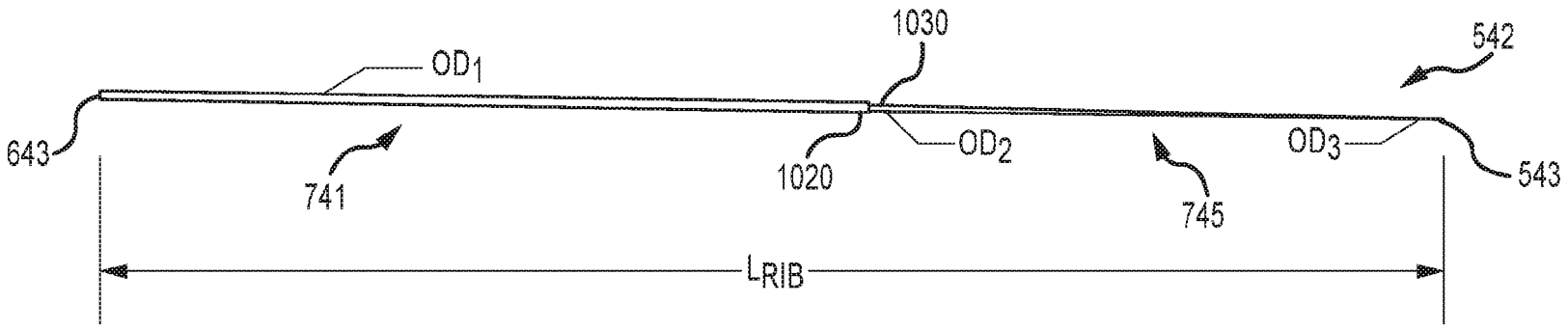
FIG. 10 illustrates one implementation of a support rib or arm for use in a deploy and retract assembly of the present description.

FIG. 10 illustrates such a rib 542 in even further detail. The rib 542 has an overall length, $L_{Rib}$, that is chosen to suit a particular canopy diameter such as 5 to 20 feet or the like. Some percent (e.g., 40 to 70 percent) of this length may be provided by the inner section 741 and the remaining length by the outer section 745. The inner section 741 may have a single outer diameter, $OD_1$, as shown or may be tapered. In one embodiment, the greater stiffness of the inner section 741 is provided by using a metal rod such as an aluminum rod, a steel rod, or a Chromalloy® or similar material rod with an outer diameter of 0.25 to 1 inches. The outer section 745 may have a single outer diameter or be tapered as shown to have differing outer diameters along its length leading to differing stiffness or rod flex along its length (e.g., to have a reducing stiffness or greater rod flex). Particularly, the outer section 745 is shown to be affixed at a first or inner end 1030 to the outer end 1020 of the inner section 741. The outer diameter, $OD_2$, at this inner end 1030 is greater than the outer diameter, $OD_3$, at the outer tip or end 543 of the outer section 745 (and rib 542).

The amount of tapering may be varied to provide a desired decreasing stiffness (or increasing rod flex), with one embodiment having a decrease in outer diameter in the range of 50 to 80 percent. The material for outer section 745 may match that of the inner section or may differ such as through the use of a plastic, fiberglass, graphite, or combination thereof when the inner section is a metal tube or rod. The inner and outer sections 741, 745 may be solid rods or may be tubular to practice the system 500 as long as desired strength to withstand expected forces in use and to achieve desired flexibility (or desired stiffness levels).

The termination of the ribs (e.g., fiberglass rods or the like as may be used for the outer sections of each long rib/arm) within the fabric structure of the canopy can be challenging. One solution used was to provide a ferrule (e.g., a stainless steel ferrule) containing a loop or hole at the end of each rib. This can be stitched to a heavy duty casing that is integral to the outer perimeter of the fabric of the canopy. The attachment ferrule (or ring) serves two distinct purposes: (1) prevent the misalignment of the fabric to the ribs; and (2) mitigate any chance of the ribs exiting the fabric channel in the event of rib failure. Replacement of the ribs is accomplished by the removal of the stitching, replacement of the broken rib, and re-stitching through the fabric channel/ring combination.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A system for providing weather protection, comprising:

an enclosure with an inner chamber and an outlet to the inner chamber;

a canopy;

a deploy and retract assembly comprising a canopy support assembly supporting the canopy, wherein the deploy and detract assembly operates to move the canopy support assembly to move the canopy into the inner chamber and out of the inner chamber;

a controller generating control signals to operate the deploy and retract assembly to retract the canopy by moving the canopy support assembly to move the canopy through the outlet into the inner chamber and to deploy the canopy by moving the canopy support assembly to move the canopy through the outlet to be at least partially outside of the inner chamber; and a sensor providing sensor data to the controller, wherein the controller processes the sensor data and, in response, triggers operation of the deploy and retract assembly to deploy the canopy by performing the moving of the canopy support assembly to move the canopy through the outlet and wherein the sensor senses at least one of rain and temperature in a predefined area about the enclosure.

2. The system of claim 1, wherein the controller operates the deploy and retract assembly to position the canopy in an full deployment stage with the canopy having a first outer diameter and in an intermediate deployment stage with the canopy having a second outer diameter less than the first outer diameter.

3. The system of claim 2, wherein the canopy is positioned wholly within the inner chamber when retracted by the deploy and retract assembly, whereby the canopy is hidden from view.

4. The system of claim 1, wherein the canopy comprises a sheet of flexible material with a predefined porosity in the range of 1 to 20 percent whereby the canopy is permeable to water and air and filters light without being opaque.

5. The system of claim 1, wherein the canopy support assembly comprises a plurality of ribs coupled with the canopy in a spaced apart manner and wherein each of the ribs is configured to have a first stiffness in an inner section and a second stiffness less than the first stiffness in an outer section.

6. The system of claim 5, wherein the inner section comprises a metal rod and the outer section comprises a tapered rod with a first end attached to the metal rod and having a first outer diameter and a second end distal to the first end and having a second outer diameter less than the first outer diameter.

7. The system of claim 1, wherein the canopy support assembly comprises a lower hub, an upper hub spaced apart from the lower hub, a first set of ribs with a first length, and a second set of ribs with a second length less than the first length, wherein each of the ribs of the first set are pivotally coupled at a first end to the lower hub and are coupled to the canopy, wherein each of the ribs of the second set are pivotally coupled at a first end to the upper hub and at a second end to one of the ribs of the first set.

8. The system of claim 1, wherein the outlet of the inner chamber comprise a conical-shaped support with an inner surface with an angle offset from a central axis of the inner chamber in the range of 15 to 60 degrees, whereby a portion of the canopy support assembly is supported on the inner surface when the canopy is deployed.

9. A system for providing weather protection, comprising:

a sheet of flexible material, wherein the sheet is permeable to air throughout its surface area;

a support assembly including a plurality of ribs, wherein each of the ribs is coupled to the sheet of the flexible material and extends from a first end proximate to a center of the sheet of the flexible material to a second end proximate to an outer edge of the sheet of the flexible material;

an enclosure with an inner chamber and an outlet at one end of the inner chamber; and a deploy and retract assembly comprising a lower hub and a drive assembly, wherein the first end of each of the ribs is pivotally coupled to the lower hub so that the first end of each of the ribs may rotate relative to the lower hub during deployment of the support assembly, wherein the drive assembly operates to position the lower hub within the inner chamber in a first position and in a second position, wherein the ribs are positioned wholly within the inner chamber with the lower hub in the first position and extend at least partially out of the outlet of the inner chamber with the lower hub in the second position, and wherein the sheet of flexible material extends between each adjacent pair of the ribs to provide a web that has a porosity in the range of 1 to 20 percent providing air passageways through the sheet of flexible material.

10. The system of claim 9, wherein each of the ribs has a first stiffness proximate to the first end and a second stiffness proximate to the second end and wherein the first stiffness is at least twice the second stiffness.

11. The system of claim 10, wherein each of the ribs comprises a tapered outer section including the second end and wherein the tapered outer section is formed of at least one of plastic, fiberglass, and graphite and has a circular cross section.

12. The system of claim 9, further comprising an upper hub spaced apart from the lower hub and a plurality of support arms each pivotally coupled at a first end to the upper hub and a second end to one of the ribs at a location spaced apart a distance from the first end of the rib.

13. The system of claim 12, further comprising a central shaft extending along the central axis of the inner chamber and wherein the lower and upper hubs slidingly engage the central shaft to move linearly along the central shaft when the lower hub is moved by the deploy and retract assembly.

14. The system of claim 13, wherein the sheet has an upward-facing bowl shape when the lower hub is in the second position.

15. The system of claim 9, wherein the porosity is in the range of 10 to 20 percent.

16. A system for providing weather protection, comprising:

an enclosure with an inner chamber;

a canopy;

a deploy and retract assembly comprising a canopy support assembly supporting the canopy, wherein the deploy and detract assembly is operable to move the canopy into the inner chamber and out of the inner chamber; and a controller generating control signals to operate the deploy and retract assembly to retract the canopy to be folded upon itself at an outer diameter less than about a diameter of the inner chamber and to be wholly within the inner chamber and to operate the deploy and retract assembly to deploy the canopy to be at least partially outside of the inner chamber and to be at least partially unfurled, wherein the canopy support assembly comprises a plurality of ribs coupled with the canopy in a spaced apart manner, wherein each of the ribs is configured to have a first stiffness in an inner section and a second stiffness less than the first stiffness in an outer section that comprises a tapered rod with a circular cross section, and wherein, in each of the ribs, the inner section extends from a first end pivotally coupled to a lower hub to a second end distal from the first end and the outer section extends from an inner end attached to the second end of the inner section to an outer end, whereby the inner section and the outer section are coaxial.

17. The system of claim 16, further comprising a sensor providing sensor data to the controller, wherein the controller processes the sensor data and, in response, triggers operating the deploy and retract assembly to deploy the canopy including moving the canopy at least partially outside of the inner chamber and to be at least partially unfurled, and wherein the sensor senses at least one of rain and temperature in a predefined area about the enclosure.

18. The system of claim 16, wherein the canopy comprises a sheet of flexible material with a predefined porosity whereby the canopy is permeable to air.

19. The system of claim 16, wherein the canopy support assembly comprises a lower hub, an upper hub spaced apart from the lower hub, a first set of ribs with a first length, and a second set of ribs with a second length less than the first length, wherein each of the ribs of the first set are pivotally coupled at a first end to the lower hub and are coupled to the canopy, wherein each of the ribs of the second set are pivotally coupled at a first end to the upper hub and at a second end to one of the ribs of the first set.

* * * * *